US007669590B2

(12) United States Patent
Oberhomburg

(10) Patent No.: US 7,669,590 B2
(45) Date of Patent: Mar. 2, 2010

(54) GAS COOKING SURFACE

(75) Inventor: Martin Oberhomburg, Wetter (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 212 days.

(21) Appl. No.: 10/572,713

(22) PCT Filed: Sep. 23, 2004

(86) PCT No.: PCT/EP2004/010685

§ 371 (c)(1),
(2), (4) Date: Mar. 17, 2006

(87) PCT Pub. No.: WO2005/031215

PCT Pub. Date: Apr. 7, 2005

(65) Prior Publication Data

US 2006/0269884 A1 Nov. 30, 2006

(30) Foreign Application Priority Data

Sep. 25, 2003 (EP) ..... 03360109

(51) Int. Cl.
*F24C 15/10* (2006.01)
*F24C 3/12* (2006.01)

(52) U.S. Cl. ..... 126/214 R; 126/39 R; 126/39 G; 126/39 BA

(58) Field of Classification Search ..... 126/214 R, 126/39 G, 39 BA; 431/73, 66, 1
See application file for complete search history.

(56) References Cited

U.S. PATENT DOCUMENTS 5,575,638 A 11/1996 Witham et al.
5,924,857 A * 7/1999 Frasnetti et al. ..... 431/6
5,938,425 A * 8/1999 Damrath et al. ..... 431/62
6,050,808 A * 4/2000 Schloss ..... 431/86
6,161,506 A * 12/2000 Hanson ..... 122/18.3
6,287,108 B1 * 9/2001 Rothenberger et al. ..... 431/12
7,150,626 B2 * 12/2006 Clauss et al. ..... 431/6
2005/0089809 A9 * 4/2005 Repper et al. ..... 431/66

FOREIGN PATENT DOCUMENTS

DE 41 33 660 4/1993
DE 94 07 567 7/1994

(Continued)

OTHER PUBLICATIONS

International Search Report PCT/EP2004/010685.

*Primary Examiner*—Kenneth B Rinehart
*Assistant Examiner*—Chuka C Ndubizu
(74) *Attorney, Agent, or Firm*—James E. Howard; Andre Pallaples

(57) ABSTRACT

A gas cooking surface, including at least one gas burner and a control device for adjusting the heating capacity stages of the burner. The gas burner operates depending on the heating capacity stage adjusted in a continuous mode in which the gas burner is continuously supplied with gas, or in a clocked mode in which the gas burner is supplied with gas in an intermittent manner. In order to allow for a user-friendly handling of the cooking surface, the control device, for adjusting the desired heating capacity stage, is provided with at least one touch contact that switches, without respect of the mode of operation, between the different heating capacity stages when actuated by the user.

22 Claims, 2 Drawing Sheets

FOREIGN PATENT DOCUMENTS

Figure 1:
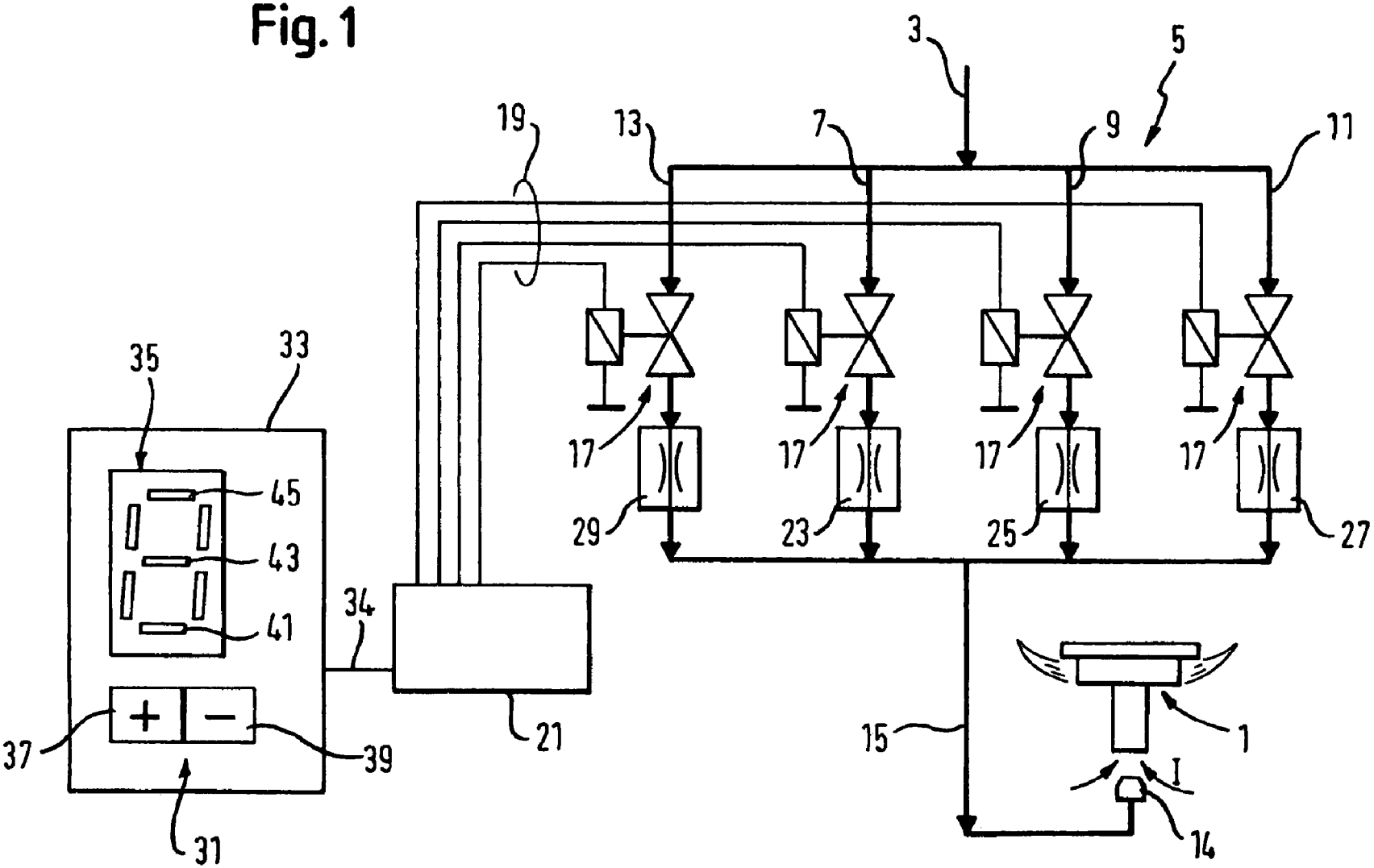

| | | |
|---|---|---|
| DE | 101 01 733 | 7/2002 |
| EP | 0 135 157 | 3/1985 |
| EP | 0 773 409 | 5/1997 |
| EP | 0 836 054 | 4/1998 |
| EP | 1 215 441 | 6/2002 |
| WO | WO 01/29483 | 4/2001 |

* cited by examiner

GAS COOKING SURFACE

The invention relates to a gas cooking surface comprising at least one gas burner and a control device for adjusting the heating capacity stages, which gas burner, depending on the adjusted heating capacity stage, operates in a continuous mode in which gas is supplied continuously to the heating element, or in a clocked mode in which the gas burner is supplied with gas in an intermittent manner.

Known from U.S. Pat. No. 5,575,638 is a generic gas cooking surface which can be operated in a continuous operating mode or in pulsed sequence operation. In pulsed sequence operation the burner is switched on and off in a time-controlled fashion. It is thereby possible to adjust a heating power below a minimum heating power at which the gas burner operates in the continuous mode with a minimal gas supply.

Known from EP 0 729 292 is a gas cooking surface with a power regulator having a plus push-button and a minus push-button. When the gas cooking surface is switched on by actuating the minus-push-button once, a push-button device directly switches on a moderate cooking stage. When the gas cooking surface is switched on by actuating a plus push-button once, the push-button device directly switches on the maximum cooking stage.

The object of the invention is to provide a gas cooking surface wherein user-friendly operation is ensured.

The object is solved by a gas cooking surface having the features of claim 1. According to the characterising part of claim 1, the control device has a touch contact for switching between the heating capacity stages which switches the heating capacity stages associated with the continuous operating mode and the clocked mode. This results in an advantageous reduction of components compared for example with two push-button switches each responsible for the clocked mode and the continuous mode.

It is advantageous in terms of control technology if the gas burner can be switched on by a first actuation of the touch contact once. A separate on-switch for operating the gas burner is thus not necessary. The gas cooking surface can be activated before switching on by a separate main switch.

It is preferable if the control device automatically adjusts a starting heating capacity stage where the gas burner operates in the continuous mode when the gas burner is switched on by the touch contact. This avoids the clocked mode of the gas burner immediately after switching on. Any confusion as to whether there may be a fault in the gas burner during an "off" time of the gas burner in the clocked mode is therefore avoided. Starting from the predetermined starting heating capacity stage, the touch contact can switch to the desired heating capacity stage by a further touch actuation.

For safety reasons it can be advantageous if the starting heating power automatically adjusted by the control device is a minimum heating power in the continuous mode of the gas burner.

It is user-friendly if the control device has a plus-button for increasing the heating power and a minus button for reducing the heating power. In particular, a user-friendly power adjustment which is also favourable with regard to cleaning is achieved with the plus and minus buttons in combination with a seven-segment display.

The gas burner can preferably be switched on by a first actuation of the plus button and/or minus button of the control device. In this case, an additional separate on-switch can be omitted. It is optionally possible to switch on the gas burner after an additional main switch has activated the gas cooking surface.

The gas burner can preferably be switched on by a first actuation of the plus button of the power regulator. The control device can then automatically adjust a starting heating power. In this case, it is preferable if the starting heating capacity stage is a minimal heating capacity stage in the continuous mode.

A stepwise increase in the power of the gas burner is achieved by a further actuation of the plus button.

It can also be advantageous if the gas burner is switched on by a first actuation of the minus button of the control device. In this case, it is preferable if the starting heating power corresponds to a maximum heating power in the continuous mode.

For an exact adjustment of the heating power of the gas burner in a lower power range it is favourable if the gas burner operates in the clocked mode in the lower power range. As a result, an exactly defined quantity of gas can be supplied to the gas burner in the lower power range.

The gas burner can be switched off by actuating the minus button at an adjusted minimal heating power in the clocked mode. Alternatively, the gas burner can be switched off by simultaneously actuating the plus button and the minus button. The gas burner can also be switched off by actuating the plus button at an adjusted maximum heating power in the continuous mode.

Figure 2:
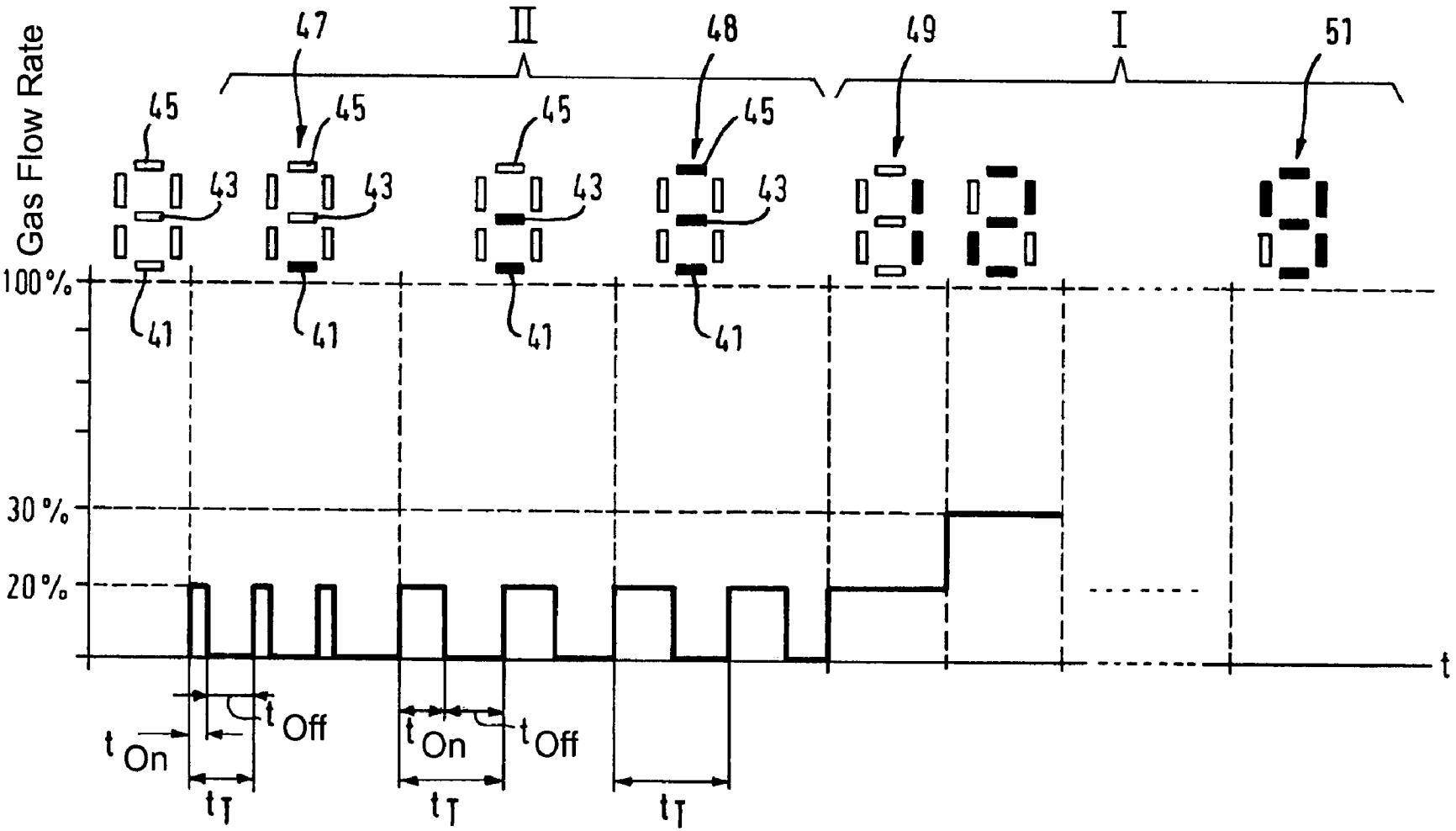

An exemplary embodiment of the invention is explained hereinafter with reference to the appended figures. In the figures:

FIG. 1 is a schematic block diagram of a gas cooking surface comprising a control panel, a gas valve control arrangement and a gas burner; and FIG. 2 is a diagram showing the gas flow rate as a function of the adjusted heating capacity stages and a respectively allocated sign which is displayed by a display device.

FIG. 1 is a highly schematic diagram showing a gas burner 1 of a gas cooking surface. This is connected via a main pipe 3 to a gas pipe network. A gas valve control arrangement 5 is located in the main pipe 3. A gas throughput to the gas burner 1 is adjusted according to a desired heating power by means of the control arrangement 5. The usual safety elements for a gas cooking surface such as a thermocouple and a relevant solenoid valve for safety shutdown of the gas burner if a flame goes out are not shown.

The control arrangement 5 comprises four control lines 7, 9, 11, 13 switched in parallel. These control lines branch off from the main pipe 3 and then combine again to form a burner supply line 15. This opens into a burner nozzle 14. Located in each of the control lines 7 to 13 is an electrically actuated solenoid valve 17. The solenoid valves 17 can be switched between a closed position and an open position and are controlled via signal lines 19 by means of an electronic control device 21. A user can adjust heating capacity stages of the gas burner 1 via the control device 21.

The control device 21 can control the solenoid valves 17 independently of one another. Located after the solenoid valves 17 disposed in the control lines 7, 9, 11, 13 are throttle elements 23, 25, 27, 29. The diameter of each throttle element determines it flow cross-section. If all the control lines 7, 9, 11, 13 are opened, a maximum gas throughput is fed to the burner.

The flow cross-section of the throttle elements are designed at the factory. In this case, the first throttle element 23 passes through about 20%, the second throttle element 25 about 24%, the third throttle element 27 about 30% and the fourth throttle element 29 about 35% of the maximum gas throughput. By means of the solenoid valves 17 switched in parallel in the control lines, 16 (i.e. $2^4$) theoretically adjustable heating capacity stages with different partial gas throughputs are obtained by combinations of open and closed positions. From these nine heating capacity stages are selected at the factory and stored in the control device 21. The heating capacity stages stored in the control device 21 are adjustable by means of a power regulator 31. This is arranged in a control panel 33 and is connected to the control device 21 via a signal line 34. Also located in the control panel 33 is a display device 35 in the form of a conventional, one-digit seven-segment display. The power regulator 31 has a plus button 37 and a minus button 39.

The gas throughput of 20% of the maximum gas throughput provided by the throttle element 23 in the control line 7 corresponds to a minimal gas throughput or a minimal heating power. At the minimal heating power continuous operation of the gas burner 1 is still possible without the flame going out (minimum continuous gas throughput). When the power regulator 31 is adjusted to this minimum heating capacity stage, the control device 21 therefore permanently opens the solenoid valve 17 in the first control line 7. The solenoid valves of the other control lines on the other hand are kept closed. For heating powers below the minimum possible continuous gas throughput of 20%, the control device 21 drives the solenoid valve 17 of the control line 7 open and closed in a clocked mode. At the same time, every time the solenoid valve in the control line 7 is opened, the ignition device not shown is actuated for renewed ignition of the gas burner. Depending on the cycle times predefined by the control device 21, it is thus also possible to adjust heating powers below the minimal continuous gas throughput.

As can be seen from the diagram in FIG. 2, the power stages of the gas burner 1 can be divided into a first group I and a second group II. In the first group I the gas burner 1 operates in the continuous mode. In the second group II the gas burner 1 operates in the clocked mode. The first power stage group I is allocated symbols from a first set of symbols. The first set of symbols consists of numbers from a series of numbers from "0" to "9" which are displayed in the seven-segment display 35. The second power stage group II comprises power stages in which the gas burner operates in clocked mode. The second power stage group II is allocated symbols from a second set of symbols. The second set of symbols is obtained from combinations of the three transverse segments 41, 43, 45 of the seven-segment display 35 located one above the other. These are indicated in different numbers in the seven-segment display 35.

Operation of the gas burner 1 in the lowest power stage 47 in the clocked mode II is described hereinafter with reference to FIG. 2. The lowest power stage 47 is shown by the symbol "_" in the seven-segment display 35 in FIG. 2. In this power stage 47 of the gas burner 1 only the lower transverse segment 41 of the seven-segment display 35 is displayed according to the diagram in FIG. 2. In this case, the gas burner 1 is driven in clocked mode. In this case, an "on" time $t_{on}$ is 10 seconds and an "off" time $t_{off}$ is 50 seconds in a clock interval $t_T$ of one minute. By touching the plus button 37 once, the user sets the next higher power stage which is indicated by the sign "=". This power stage is indicated by controlling the lower transverse segment 41 and the middle transverse segment 43 of the seven-segment display 35. In this case, the "on" time $t_{on}$ is 20 seconds and the "off" time $t_{off}$ is 40 seconds. The highest power stage 48 in the clocked mode is reached by touching the plus button 37 again. The highest power stage 48 is shown in the seven-segment display 35 as "≡" with the three transverse segments 41, 43, 45 selected. In the power stage 48 $t_{on}$=30 seconds and $t_{off}$=30 seconds.

By touching the plus button 37 again, the control device 21 switches from the power stage 48 to the next higher power stage 49 which is indicated in the seven-segment display 35 by the sign "1" as shown in FIG. 2. In this power stage 49 the minimum gas supply of 20% required for continuous operation of the gas burner is fed continuously to the burner 1. The further heating powers up to the highest power stage 51 which is represented by the sign "9" and is associated with a maximum heating power of the gas burner can be adjusted in a corresponding manner by means of the power regulator 31. The minus button 39 of the power regulator 31 should be actuated to reduce the heating power of the gas burner 1 as far as the lowest heating power stage 47 with the sign "_".

The gas burner 1 is switched on by first actuating the plus button 37 of the power regulator 31. The control device 21 then automatically adjusts the heating power stage 49 as a starting heating power stage as is indicated by the symbol "1" in FIG. 2. The continuous operating mode of the gas burner 1 is possible in the starting heating power stage 49. In this power stage 49 the minimum continuous gas supply of 20% of the maximum gas throughput ensures the continuous operating mode of the gas burner 1. Since the continuous operating mode can be adjusted at the start of the cooking process, any confusion of the user as to the operating capability of the gas burner 1 can be avoided. In the time interval $t_{off}$ in the clocked mode of the gas burner 1, the user could incorrectly assume a burner defect at the start of the burner operation. Before switching on the gas burner 1 for safety reasons the gas cooking surface can be initially activated by means of a main switch not shown.

Alternatively, the gas burner 1 can also be switched on by actuating the minus button 39. In this case, it can be advantageous if the control device 21 automatically sets the power stage 51 with the sign "9". In this power stage 51 the gas burner 1 operates in the continuous operating mode at maximum heating power. A corresponding reduction in the heating power is effected by further actuation of the minus button 39.

In the present case the gas burner 1 is switched off by simultaneously actuating the plus button 37 and the minus button 39. Alternatively, the gas burner 1 can be switched off when the minus button 39 is pressed in the lowest power stage 47.

The invention claimed is:

1. A gas cooking surface, comprising:

at least one gas burner;

a gas supply coupled to said gas burner for supplying gas thereto;

a control device for adjusting the heating capacity stages of said gas burner;

said gas burner, depending on said adjusted heating capacity stage, operates in one of a continuous mode in which said gas is supplied continuously to said gas burner or a clocked mode in which said gas burner is supplied with said gas in controlled pulsating manner;

said control device including a touch contact for switching between said heating capacity stages;

said touch contact controlling said heating capacity stages associated with said continuous mode and also with said clocked mode; and said control device automatically controls said burner to a starting heating capacity stage in which said gas burner operates in said continuous mode when said gas burner is switched on by said touch contact, said control device is set to initially operate said burner in an initial continuous mode of operation upon actuation of the starting touch control switch and to subsequently operate said burner in said continuous mode or said clocked mode upon further actuation of the touch contact to select either the continuous mode or the clocked mode.

2. The gas cooking surface according to claim 1, wherein said gas burner is switched on by a first actuation of said touch contact.

3. The gas cooking surface according to claim 2, wherein said starting heating capacity stage automatically adjusted by said control device is a minimal heating capacity stage in said continuous mode.

4. The gas cooking surface according to claim 2, wherein said touch contact has at least one of a plus button for increasing the heating capacity and a minus button for reducing said heating capacity.

5. The gas cooking surface according to claim 4, wherein said gas burner is switched on by a first actuation of at least one of said plus button and said minus button.

6. The gas cooking surface according to claim 4, wherein said touch contact has both said plus button for increasing said heating capacity and said minus button for reducing said heating capacity, and said gas burner is switched off by simultaneously actuating said plus button and said minus button.

7. The gas cooking surface according to claim 4, wherein said touch contact has both said plus button for increasing said heating capacity and said minus button for reducing said heating capacity, and said gas burner is switched off by actuating said minus button in a minimum heating power stage in said clocked mode.

8. The gas cooking surface according to claim 4, wherein said touch contact has both said plus button for increasing said heating capacity and said minus button for reducing said heating capacity, and said gas burner is switched off by actuating said plus button in a maximum heating power stage in said clocked mode.

9. The gas cooking surface according to claim 4, wherein said gas burner operates in an upper heating capacity range in said continuous mode and in a lower heating capacity range in said clocked mode.

10. The gas cooking surface according to claim 5, wherein said touch contact has both said plus button for increasing said heating capacity and said minus button for reducing said heating capacity, and a maximum heating capacity stage in said continuous mode is set when said minus button is first actuated to switch on said gas burner.

11. The gas cooking surface according to claim 1, wherein the touch contact includes only a plus button and a minus button to select between and to control operation of the gas burner in the continuous mode and the clocked mode.

12. A method of operating a gas cooking surface, comprising:

providing at least one gas burner;

coupling a gas supply to said gas burner for supplying gas thereto;

adjusting the heating capacity stages of said gas burner;

operating said gas burner, depending on said adjusted heating capacity stage, in one of a continuous mode in which said gas is supplied continuously to said gas burner or a clocked mode in which said gas is supplied intermittently to said gas burner;

said control device including a touch contact for switching between said heating capacity stages;

touching said touch contact for switching said heating capacity stages in said continuous mode and also in said clocked mode; and automatically adjusting said burner to a starting heating capacity stage in which said gas burner automatically operates in an initial continuous mode when said gas burner is switched on by touching said touch contact, and subsequently the gas burner operates in the continuous mode or the clocked mode depending upon further actuation of the touch contact to select either the continuous mode or the clocked mode.

13. The operating method according to claim 12, including switching on said gas burner by a first actuating of said touch contact.

14. The operating method according to claim 13, including automatically adjusting said starting heating capacity stage to a minimal heating capacity stage in said continuous mode.

15. The operating method according to claim 13, including providing said touch contact with at least one of a plus button for increasing the heating capacity and a minus button for reducing said heating capacity.

16. The operating method according to claim 12, including switching on said gas burner by a first actuating of at least one of said plus button and said minus button.

17. The operating method according to claim 16, including providing said touch contact with both of said plus button for increasing said heating capacity and said minus button for reducing said heating capacity and setting a maximum heating capacity stage in said continuous mode when said minus button is first actuated for switching on said gas burner.

18. The operating method according to claim 12, including providing said touch contact with both of said plus button for increasing said heating capacity and said minus button for reducing said heating capacity and switching off said gas burner by simultaneously actuating said plus button and said minus button.

19. The operating method according to claim 12, including providing said touch contact with both of said plus button for increasing said heating capacity and said minus button for reducing said heating capacity and switching off said gas burner by actuating said minus button in a minimum heating power stage in said clocked mode.

20. The operating method according to claim 12, including providing said touch contact with both of said plus button for increasing said heating capacity and said minus button for reducing said heating capacity and switching off said gas burner by actuating said plus button in a maximum heating power stage in said clocked mode.

21. The operating method according to claim 12, including operating said gas burner in an upper heating capacity range in said continuous mode and operating said gas burner in a lower heating capacity range in said clocked mode.

22. The operating method according to claim 12, wherein the touch contact includes only a plus button and a minus button to select between and to control operation of the gas burner in the continuous mode and the clocked mode.

* * * * *